US011295637B1

(12) United States Patent
Butler

(10) Patent No.: US 11,295,637 B1
(45) Date of Patent: Apr. 5, 2022

(54) FADE RESISTANT POSTED MARKER SIGN

(71) Applicant: John Wayne Butler, Fayetteville, AR (US)

(72) Inventor: John Wayne Butler, Fayetteville, AR (US)

( * ) Notice: Subject to any disclaimer, the term of this patent is extended or adjusted under 35 U.S.C. 154(b) by 0 days.

(21) Appl. No.: 16/952,555

(22) Filed: Nov. 19, 2020

Related U.S. Application Data

(60) Provisional application No. 62/938,108, filed on Nov. 20, 2019.

(51) Int. Cl.
*G09F 7/18* (2006.01)
*G09F 7/00* (2006.01)

(52) U.S. Cl.
CPC ..... *G09F 7/18* (2013.01); *G09F 7/002* (2013.01); *G09F 2007/1817* (2013.01)

(58) Field of Classification Search
CPC ..... G09F 7/18; G09F 7/002; G09F 2007/1817
See application file for complete search history.

(56) References Cited

U.S. PATENT DOCUMENTS 1,444,641 A 2/1923 Rowe
3,729,847 A * 5/1973 Chandos ..... G09F 7/18 40/604
4,078,754 A * 3/1978 Gould ..... E04H 17/06 248/218.4
4,250,647 A * 2/1981 Woodard ..... G09F 7/20 248/244
4,686,144 A * 8/1987 Hupfer ..... G09F 3/02 428/35.8
4,798,017 A * 1/1989 Giotis ..... G09F 7/002 116/63 P
5,211,404 A 5/1993 Grant ..... 273/407
5,560,131 A * 10/1996 Gibson ..... G09F 7/20 40/607.12
5,956,875 A * 9/1999 Aughenbaugh ..... G09F 7/10 40/607.03
6,440,582 B1 8/2002 McDevitt et al. ..... 428/653
6,720,042 B2 4/2004 Ylitalo et al. ..... 428/32.26
6,730,714 B2 5/2004 Ylitalo et al. ..... 522/74
7,579,388 B2 8/2009 Kiefer ..... 522/121
7,694,447 B1 * 4/2010 Rutler ..... G09F 7/002 40/654.01
7,943,681 B2 5/2011 Lee et al. ..... 522/114
8,628,065 B2 * 1/2014 Reid ..... A01K 3/005 256/10
9,322,189 B2 4/2016 Beale
9,567,469 B2 2/2017 Haines ..... 427/421.1
2016/0290552 A1 * 10/2016 Holestine ..... E04H 17/1417

* cited by examiner

*Primary Examiner* — David R Dunn
*Assistant Examiner* — Christopher E Veraa
(74) *Attorney, Agent, or Firm* — Keisling & Pieper PLC; David B. Pieper; Trent C. Keisling

(57) ABSTRACT

A flexible fade resistant posted marker sign based on a flexible substrate and fade resistant coating that can bend to lock onto a studded flanged post by positioning the sign ends between the studs on the post with the body arching across and over middle studs on the post with the sign being wide enough to span across the flanges of the post and be secured with wire passing through holes positioned to place the wire at the sides of the width of the post to inhibit vertical, horizontal, and twisting movement of the sign while still maintaining a continuous center section of the sign for use as a colored warning blaze.

2 Claims, 4 Drawing Sheets

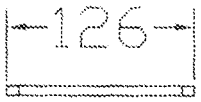
Fig. 4
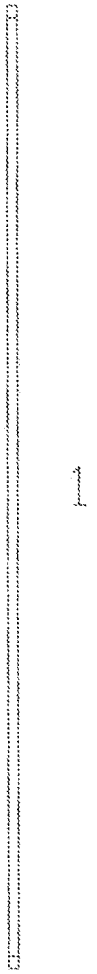
Fig. 5
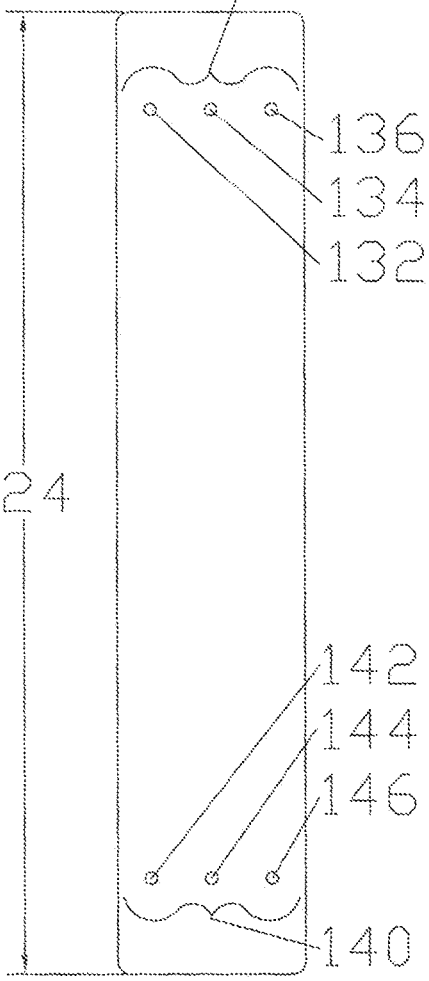
Fig. 6
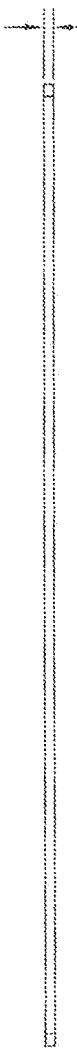
Fig. 7
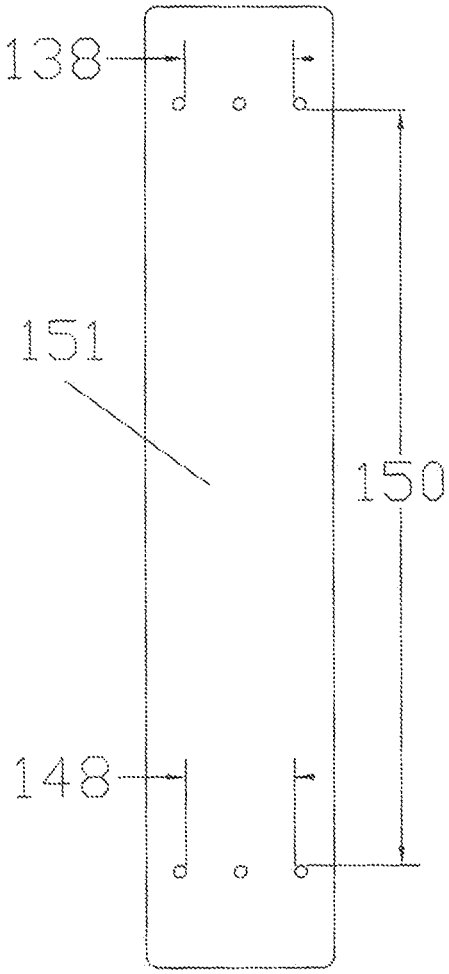
Fig. 8
Fig. 9

FADE RESISTANT POSTED MARKER SIGN

CROSS-REFERENCE TO RELATED APPLICATIONS

This application claims priority to and is a continuation-in-part of U.S. Patent Application Ser. No. 62/938,108, filed on Nov. 20, 2019 entitled Fade Resistant Posted Marker Sign which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in signs. More particularly, the invention relates to improvements particularly suited for providing fade resistant signs that last for years in exposed weather environments. In particular, the present invention relates specifically to a fade resistant posted marker sign that can alternatively be securely attached to a metal T-post, wooden post, or tree and secured at the proper height without slippage or movement for long term marking of no hunting or no trespassing boundaries.

2. Description of the Known Art

As will be appreciated by those skilled in the art, posting a no trespassing, sign at a roadway entrance to a property is well known along with painting marking blazes around the boundaries of that property. The entrance signs are normally a horizontal sign with large NO Trespassing letters and the blazes are a vertical stipe painted directly onto tree or directly onto a fence post. For example, the law in Arkansas states:

"The owner or lessee of any real property other than forest land, including cultivated land, orchards, pasture land, impoundments, or other real property, may post such real property by any of the following methods:

(2) (A) By placing identifying paint marks on posts around the area to be posted.

(B) Each paint mark shall be a vertical line of at least eight inches (8") inches in length, and the bottom of the mark shall be no less than three feet (3') nor more than five feet (5') high.

(C) Such paint marks shall be placed no more than one thousand feet (1,000') apart and at each point of entry and shall be readily visible to any person approaching the property.

(D) (i) The type and color of the paint to be used for posting shall be prescribed by regulation by the Arkansas Forestry Commission."

In Arkansas, the posting paint is a purple, semi-paste, tree marking paint which meets or exceeds the following specifications: Solid Pigments (Base color)—62.6%. Titanium Dioxide—22.2%, Calcium Carbonate—77.8%; Vehicle (varies with manufacturer)—37.4%, Oleoresinus Vehicle—47.2%, Petroleum Solvents—45.4%; Driers, wetting agents, and tinting materials (lamp black, red iron oxide, magenta)—7.4%.

Similarly in Missouri, the laws and regulations are as follows:

"569.145. Posting of property against trespassers, purple paint used to mark streets and posts, requirements.—In addition to the posting of real property as set forth in section 569.140, the owner or lessee of any real property may post the property by placing identifying purple marks on trees or posts around the area to be posted. Each purple mark shall be:

(1) A vertical line of at least eight inches in length and the bottom of the mark shall be no less than three feet nor more than five feet high. Such marks shall be placed no more than one hundred feet apart and shall be readily visible to any person approaching the property; or (2) A post capped or otherwise marked on at least its top two inches. Die bottom of the cap or mark shall be not less than three feet but not more than five feet six inches high. Posts so marked shall be placed not more titan thirty-six feet apart and shall be readily visible to any person approaching the property. Prior to applying a cap or mark which is visible from both sides of a fence shared by different property owners or lessees, ail such owners or lessees shall concur in the decision to post their own property."

The problem to be addressed is that these painted marks fade quickly and have to be reapplied regularly to maintain effectiveness.

In a separate area of art from the painted blazes, other areas of art also known in various forms. Patents disclosing information that is relevant includes: U.S. Pat. No. 7,943,681 issued to Lee, et al. on May 17, 2011 entitled Weather resistant, ink jettable, radiation curable, fluid compositions particularly suitable for outdoor applications; U.S. Pat. No. 7,579,388 issued to Kiefer on Aug. 25, 2009 entitled Radiation curable ink compositions and applications thereof; U.S. Pat. No. 6,730,714 issued to Ylitalo, et al. on May 4, 2004 entitled Inks and other compositions incorporating limited quantities of solvent advantageously used in ink jetting applications; U.S. Pat. No. 6,720,042 issued to Ylitalo, et al. on Apr. 13, 2004 entitled Primed substrates comprising radiation cured ink jetted images; U.S. Pat. No. 5,211,404 issued to Grant on May 18, 1993 entitled Target mounting system.

In a different area of art, coating systems for steel includes U.S. Pat. No. 6,440,582, issued to McDevitt, et al. on Aug. 27, 2002 entitled Coating composition for steel product, a coated steel product, and a steel product coating method.

In another area of art for consideration is U.S. Pat. No. 9,567,469, issued to Haines on Feb. 14, 2017 entitled Surface coatings and methods.

In another area of art for consideration is U.S. Pat. No. 9,322,189, issued to Beale on Apr. 26, 2016 entitled Surface composition and method of application.

Finally, the area of steel T posts should also be considered as evidenced by U.S. Pat. No. 1,444,641, issued to Rowe on Feb. 6, 1923, entitled Steel Fencepost.

Each of these patents is hereby expressly incorporated by reference in their entirety.

From these prior references it may be seen that these prior art patents are very limited in their teaching and utilization, and art improved fade resistant posted marker sign is needed to overcome these limitations.

SUMMARY OF THE INVENTION

The present invention is directed to an improved fade resistant posted vertical blaze marker. When marking large plots of land or forest with boundaries distances measured in miles, thousands of blazes may be required and these blazes have to be maintained regularly to maintain effectiveness. The prior art painted blazes deteriorate quickly and can require annual or or biannual reapplication of the painted blazes. The present invention provides a long term blaze to address this problem. In accordance with one exemplary embodiment of the present invention, a vertically elongated rectangular flexible sign is provided using a transparent ultraviolet protective layer, a purple and/or red color surface, a base weathering protective layer and a central core. The central core defines three sealed top holes and three sealed bottom holes for mounting. Of particular note is the combination of the flexible nature of the vertically elongated rectangular flexible sign, the hole spacing horizontally across the face of the sign, and the particular vertical length of the sign. These items in combination allow the top and bottom ends of the sign to bend into the recessed notches on the face of a T-post and allows the ends to rest against the outstretched post side arms to both vertically and twistingly secure the sign in position. The hole spacing matches the post width to control wire positioning during mounting o provide horizontal stabilization of the sign. This mounting, in combination with the ultraviolet protective layer allows for long term placement of the markers without requiring annual or biannual refreshing of the blazes.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 4 is a top view of a fade resistant posted marker sign

FIG. 5 is a left side view thereof;

FIG. 6 is a front view thereof;

FIG. 7 is a right side view thereof:

FIG. 8 is a back view thereof;

FIG. 9 is a bottom view thereof; and

DETAILED DESCRIPTION OF THE INVENTION

Figure 1:
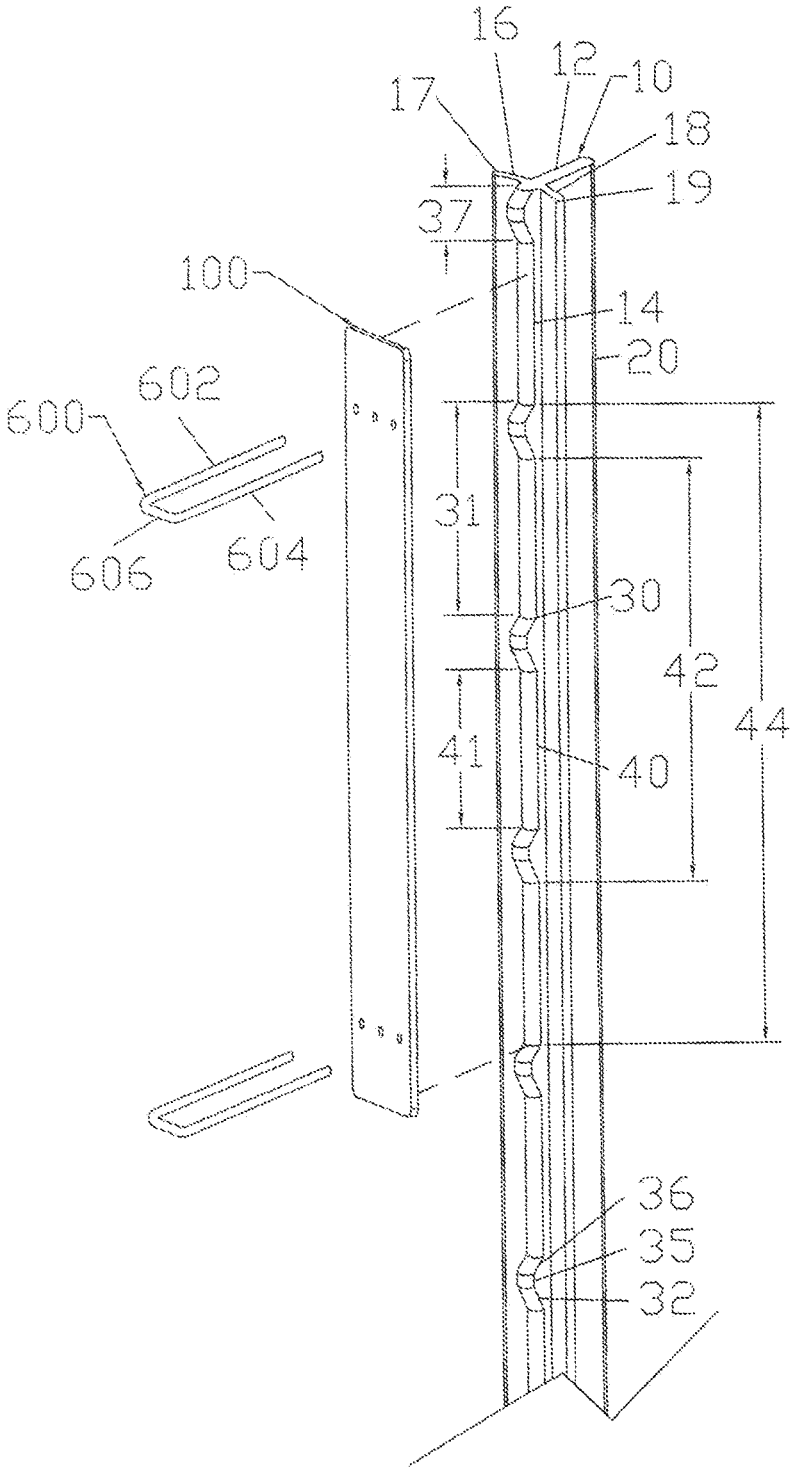
FIG. 1 is an exploded view of a fade resistant posted marker sign for installation on a T style fence post.

As shown in FIGS. 1-10 of the drawings, one exemplary embodiment of the present invention is generally shown as a fade resistant posted marker vertically elongated rectangular flexible sign 100. The fade resistant posted marker sign 100 is a sign that is legal in all fifty states and provides a posted sign in approximately one half of the states. The vertically elongated rectangular flexible sign 100 is provided using a transparent ultraviolet protective layer 200, a purple and/or red color surface 300, a base weathering protective layer 400 and a central core 500.

A fence post 10 is also called (depending on design or country) a T-post, a Y-post, or variants on star post. They are generally made of steel and are sometimes manufactured using durable rail steel. They can be used to support various types of wire or wire mesh. The end view of the post creates an obvious T, Y. or other shape. The fence posts 10 are driven into the ground with a manual or pneumatic post pounder. All along the post, along the spine, there are studs or nubs that prevent the barbed wire or mesh from sliding up or down the post. They are commonly painted with a white tip on top; white improves the visibility of the fence line.

The fence posts 10 are made from a structural T shape body 12 that includes the face rib 14, the left side rib 16, the right side rib 18, and the back rib 20. Note that the left side rib 16 and right side rib 18 may bend forward such that the left rib end 17 and right rib end 19 lie in plane with the face rib 14. The distance from the left side rib 16 to the right side rib 18 is the post width 21. The face rib 14 includes a plurality of centrally disposed and spaced studs 30 on a stud spacing distance 31 that are preferably wedge shaped with a bottom wedge 32, peak 34, top wedge 36 defining a vertical stud length 37. The studs are spaced by rib valley 40 having a vertical valley length 41. Note that the stud spacing is repetitive such that any two or more studs, or two or more rib valleys 40 are separated by a multiple of the stud spacing distance 31. In this manner the closest points of two valleys are separated by a minimum inside valley separation distance 42 and the farthest points of two valleys are separated by a maximum outside valley separation distance 44. The wedge shape of the studs 30 provides for their easy penetration in the ground when the post is driven, and the earth filling in above the top of each stud or wedge tends to seat and lock the studs 30 and thereby the post 10 in the ground while the top wedge 36 still provides an angle for removal of the post 10 if necessary.

The fade resistant posted marker sign 100 can be many sizes from one inch wide to three feet tall up to twelve inches wide by three feet tall. The preferred embodiment is 1.9375" wide horizontally by 9.375" tall vertically. Preferred sizes include two inches by eight inches, six inches by six inches, or 50 millimeters by 500 millimeters. Up to twenty pre-drilled holes can occur in any area for attachment to items such as trees, fence posts, buildings, gates, or the like. All shades of both red and purple marking colors are envisioned for the sign and are included within the scope of this application including any specific color required by any state and size minimum area requirement for posted property identification signs.

The fade resistant posted marker sign 100 is made from a flexible sign body 110. The flexible sign body 110 defines a sign front 112, sign back 114, left side 116 connected by a top left corner 117 to a top end 118 connected by a top right corner 119 to a right side 120 connected by a bottom right corner 121 to a bottom end 122 that is connected by a bottom left corner 123 to the left side 116.

The distance from the top end 118 to the bottom end 120 is the sign height 124.

The distance from the left side 116 to the right side 120 is the sign width 126.

The distance from the sign sign front 112 to the sign sign hack 114 is the sign thickness 128.

The sides 116, 120, ends 118, 122 and corners 117, 119, 121, 123 of the sign are rounded or smoothed to prevent sharp edges and injuries from cutting.

The corners 117, 119, 121, 123 all use a 0.125" radius in the preferred embodiment.

The flexible sign body 110 further defines a top hole set 130 and a bottom hole set 140. The top hole set 130 includes a horizontally aligned top left hole 132, top middle hole 134, and top right hole 136. The bottom hole set 140 with a horizontally aligned bottom left hole 142, bottom middle hole 144, and bottom right hole 146.

The top hole set 130 is parallel to the bottom hole set 140 and is spaced by a vertical hole separation distance 150. The vertical hole separation distance 150 provides a solid center section 151 for the flexible sign body 110 to meet the legal requirements for a continuous blaze.

The top middle hole 134 is horizontally centered such that it is equidistant from the left side 116 and the right side 120. Similarly, the bottom middle hole 144 is equidistant from the left side 116 and the right side 120.

The distance from the top left hole 132 to the top right hole 136 is the top horizontal outside hole separation distance 138 and the distance from the bottom left hole 142 to the bottom right hole 146 is the bottom horizontal outside hole separation distance 148. Preferably, the top horizontal outside hole separation distance 138 and bottom horizontal outside hole separation distance 148 are equal to the post width 21.

The holes 132, 134, 136, 142, 144, 146 are all 0.125" diameter in the preferred embodiment.

The central core 500 is a flexible sheet material selected for long term weathering ability and is preferably aluminum. Other preferred embodiments use a thickness of steel from a one millimeter thick material up to sixty millimeter thick material. When steel is used a base weathering protective layer 400 is provided and is preferably a galvanized alloy coating over steel. However, the currently preferred sign is made with 55% Aluminum-Zinc GALVALUME (registered trademark), available from BIEC International. Inc., 222 West Kalama River Road, Kalama, Wash. 98625. The central core 500 and base weathering protective layer 400 can also be made from galvanized steel, steel, aluminum, or any other metal, wood, plastic, or similar product for a stable base over the expected lifetime.

The purple and/or red color surface 300 and if necessary the ultraviolet protective layer 200 can be applied to one side, both sides, or the entire body and perimeter. The preferred color surface and protective layer 200 are an extrusion coating marketed as FLUROPON by The Sherwin-Williams Company, 101 W. Prospect Ave. Cleveland, Ohio 44115. This is a two or three coat, solid color fluoropolymer formulation that maintains its color and durability for extended time periods. This uses a 0.2-0.4 mils primer, a 1.2-1.5 mils coat for the color surface 300 and a 0.3-0.5 mils coat for the ultraviolet protective layer 200. In this manner, the invention uses a baked on coating designed to last 50 years or longer with fade resistance from years 5 through 50 on GALVALUME.

A bendable wire tie 600 is used to attach the sign 100 to the post 10. Aluminum is the preferred wire, although steel and stainless steel are secondary preferences. The wire tie 600 includes a left wire arm 602 and a right wire arm 604 connected by a wire back 606. The arms 602, 604 are pushed through the outside holes 132, 136 or 142, 146 and either wrapped together or around the post 10.

Figure 2:
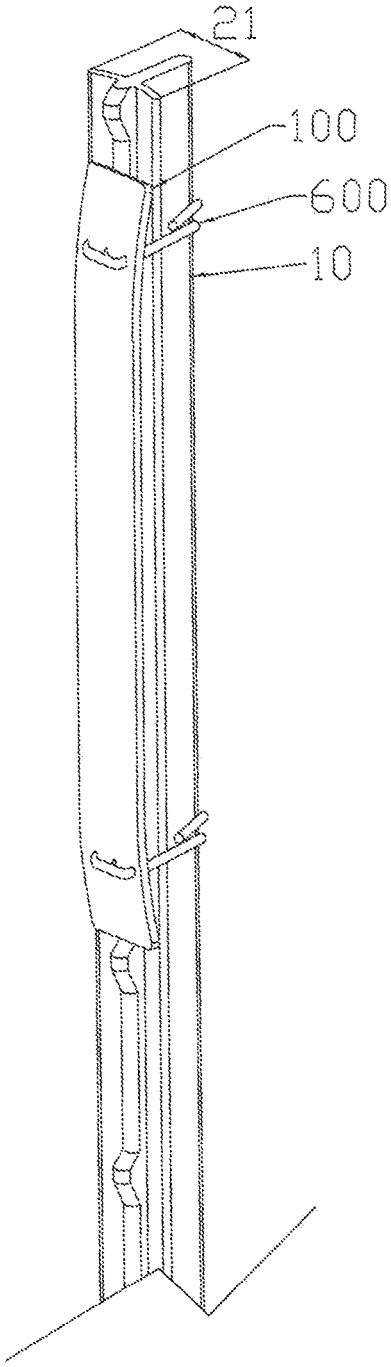
FIG. 2 is an assembled view thereof.

Installation of the sign 100 is unique for the installation of a blaze on a T post style of fence post 10. As shown in FIGS. 1 and 2 for the preferred embodiment, the vertical hole separation distance 150 is greater than the minimum valley separation distance 42 and the sign height 124 is less than the maximum valley separation distance 44 so that the ends 118, 120 can both be pulled into a valley 40 when attached by the wire tie 600. In this manner, if the sign 100 tries to move vertically the top end 118 or bottom end 120 will contact a stud 30 to prohibit vertical movement of the sign 100. Additionally, because the top horizontal outside hole separation distance 138 and bottom horizontal outside hole separation distance 148 are equal to the post width 21, the installation of the wire tie 600 through the top left hole 132 and bottom left hole 142 aligns the left wire arm 602 of the wire tie with the left rib end 17 and the installation of the wire tie 600 through the top right hole 136 and bottom right hole 146 aligns the right wire arm 604 with the right rib end 19 to prohibit movement of the sign 100. Twisting of the sign 100 is prohibited because the top end 188 and bottom end 120 span the planar front of the post 10 from the left rib end 17 across the face rib 14 to the right rib end 19. Because the solid center of the sign spans the suds, a continuous blaze is maintained on the post 10. Thus, the combination of the flexible nature of the vertically elongated rectangular flexible sign 100, the hole spacing horizontally across the face of the sign 100, and the particular vertical length of the sign 100 work in combination allow the ends of the sign to bend into the recessed notches on the face of a T-post 10 and allows the ends to rest against the outstretched arms to vertically, horizontally and twistingly secure the sign 100 in position. This mounting, in combination with the ultraviolet protective layer allows for long term placement of the markers without requiring annual or biannual refreshing of the blazes.

Figure 3:
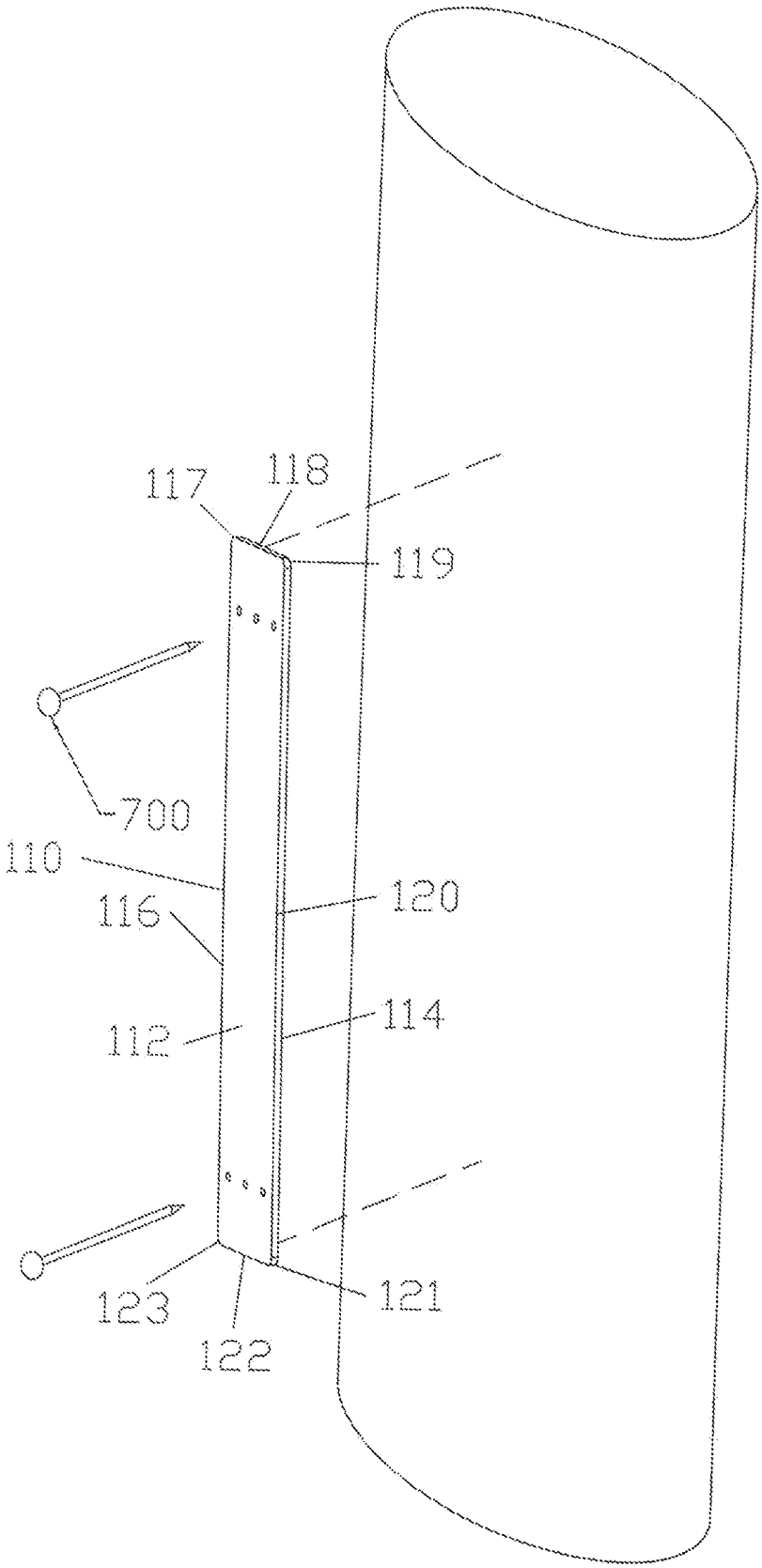
FIG. 3 is an exploded view of a fade resistant posted marker sign for installation on a tree or wooden fence post.
Figure 10:
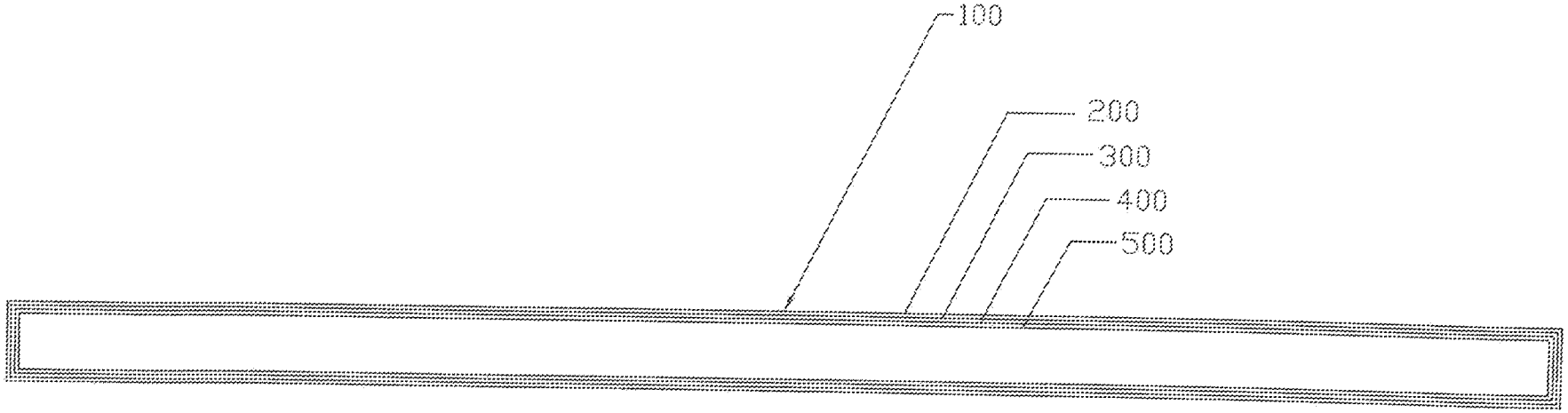
FIG. 10 is a cross sectional view showing the layers.

FIG. 3 shows how the same sign may be attached to a wooden post or tree simply using a screw or nail type of fastener 700 through the center holes. Thus, only type of sign has to be carried for multiple applications.

Reference numerals used throughout the detailed description and the drawings correspond to the following elements:

fence post 10
structural T shape body 12
face rib 14
left side rib 16
left rib end 17
right side rib 18
right rib end 19
back rib 20
post width 21
centrally disposed and spaced studs 30
stud spacing distance 31
bottom wedge 32
peak 34
top wedge 36
vertical stud length 37
rib valley 40
vertical valley length 41
minimum valley separation distance 42
maximum valley separation distance 44 fade resistant posted marker vertically elongated rectangular flexible sign 100
flexible sign body 110
sign front 112
sign back 114
left side 116
top left corner 117
top end 118
top right corner 119
right side 120
bottom right corner 121
bottom end 122
bottom left corner 123
sign height 124
sign width 126
sign thickness 128
top hole set 130
top left hole 132
top middle hole 134
top right hole 136
bottom hole set 140
bottom left hole 142
bottom middle hole 144
bottom right hole 146
vertical hole separation distance 150
solid center section 151
top horizontal outside hole separation distance 138
bottom horizontal outside hole separation distance 148
transparent ultraviolet protective layer 200
color surface 300
base weathering protective layer 400
central core 500.
bendable wire tie 600
left wire arm 602
right wire arm 604
wire back 606
screw or nail type of fastener 700

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A posted marker vertically elongated rectangular flexible sign apparatus for mounting on a fence post, comprising:

the fence post including a structural T shape body defining a face rib, a left side rib having a left rib end, a right side rib having a right rib end, the left rib end separated from the right rib end by a post width, centrally disposed studs a first rib valley and a second rib valley positioned along the face rib at a stud spacing distance, each stud including a bottom wedge, a peak, and a top wedge defining a vertical stud length, and each of the first and second rib valley having a vertical valley length with two valleys defining a minimum valley separation distance and a maximum valley separation distance a flexible sign body including sides and a top end and a bottom end defining a sign height between the minimum valley separation distance and a maximum valley separation distanced, the flexible sign body including a central core, a base weathering protective layer, a color surface and a transparent ultraviolet protective layer; and the flexible sign body defining a top hole set and a bottom hole set separated by a vertical hole separation distance forming a solid center section;

the vertical hole separation distance between the minimum valley separation distance and a maximum valley separation distance;

each hole set defining a horizontal outside hole separation distance equal to the post width; and a bendable wire tie including a bent body defining a left wire arm and a right wire arm connected by a wire back, the bendable wire tie positioning the top end in the first rib valley and the bottom end in the second rib valley.

2. The posted marker vertically elongated rectangular flexible sign apparatus of claim 1, further comprising:

each hole set including a middle hole equidistantly positioned from the sides.

* * * * *